United States Patent [19]

Nakaguchi et al.

[11] 4,048,958

[45] Sept. 20, 1977

[54] MAGNETIC BRUSH DEVELOPING DEVICE

[75] Inventors: Michiharu Nakaguchi; Toshio Nagashima, both of Ebina, Japan

[73] Assignee: Fuji Xerox Co., Ltd., Tokyo, Japan

[21] Appl. No.: 664,680

[22] Filed: Mar. 8, 1976

[51] Int. Cl.[2] ..... B05B 5/02

[52] U.S. Cl. ..... 118/658

[58] Field of Search ..... 118/637, 312, 653, 656, 118/657, 658; 355/3 DD; 427/18

[56] References Cited

U.S. PATENT DOCUMENTS

| | | | |
|---|---|---|---|
| 3,402,698 | 9/1968 | Kojima | 118/637 |
| 3,626,898 | 12/1971 | Gawron | 118/637 |
| 3,641,980 | 2/1972 | Bickmore | 118/637 |
| 3,654,902 | 4/1972 | Hakanson | 118/637 |
| 3,739,749 | 6/1973 | Kangas et al. | 118/637 |
| 3,894,513 | 7/1975 | Stanley et al. | 118/637 |
| 3,916,830 | 11/1975 | Kojima et al. | 118/637 |

*Primary Examiner*—Henry S. Jaudon
*Attorney, Agent, or Firm*—Gerald J. Ferguson, Jr.; Joseph J. Baker

[57] ABSTRACT

A magnetic brush developing device comprising a developing roller including a cylindrical stationary magnet and a sleeve rotatably mounted around the magnet, the developing roller being disposed adjacent the surface of a latent image bearing member, the cylindrical magnet having a developing magnetic pole facing the surface of the latent image forming member and transporting magnetic poles respectively disposed above and below the developing magnetic pole in adjacent relation thereto, the transporting magnetic poles being narrower in width than and having an opposite polarity to the developing magnetic pole.

1 Claim, 3 Drawing Figures

MAGNETIC BRUSH DEVELOPING DEVICE

BACKGROUND OF THE INVENTION

1. Field of the Invention

This invention relates to a magnetic brush developing device, and more particularly to a magnetic brush developing device for use in an electrophotographic reproducing machine.

2. Discussion of the Prior Art

Magnetic brush developing devices are discloed in U.S. Pat. Nos. 2,786,439 and 2,786,440 issued to C. J. Young in 1957. A magnetic brush developing device is very effective for reproducing continuous tone images, and because of this, the device is increasingly used in electrophotographic reproducing machines or the like.

Generally in magnetic brush development, a developer consisting of an iron powder carrier and toner is formed into brush-like burs by means of a developing roller consisting of a stationary magnet and a sleeve rotating around the stationary magnet so that the brush-like burs may slidingly pass over the surface of an electrostatic latent image bearing member thereby developing the electrostatic latent image into a visual image. Transportation of the developer is effected by the sleeve rotating about the magnet and hence the transportability of the developer is largely dependent upon the magnetic field produced by the magnet used.

The magnet used in the prior art is of a rectangular cross-section as shown in FIG. 1, a sleeve 2 being rotatably mounted around the rectangular magnet. A transporting magnet 3 delivers the developer to the succeeding magnet 1.

Because the rectangular cross-sectional shape magnet 1 has magnetic poles in the right and reverse sides thereof, flux density A in the vertical direction with respect to the developing magnetic pole (as shown by phantom line A) is high, while flux density B in the direction tangential to the magnetic pole (as shown by phantom line B) is low. Since flux density B in the tangential direction contributes to transportion of the developer, the transportability of the magnetic pole in the conventional device has been extremely low, and hence the permissible range of flow rate of developer has been extremely limited. For this reason, if an increase in the amount of developer to be transported is needed for increasing the developing speed, the magnetic pole in the conventional device will fail to transport the required amount of developer properly, with the resulting accumulation of developer in the supply side of developing roller, the accumulated developer being eventually spilt off from the roller to the outside of the developing device.

SUMMARY OF THE INVENTION

It is accordingly an object of the present invention to provide an improved magnetic brush developing device for transporting developer.

Other objects and advantages of this invention will be apparent from a reading of the following specification and claims taken with the drawing.

DETAILED DESCRIPTION OF THE PREFERRED EMBODIMENT

Figure 2:
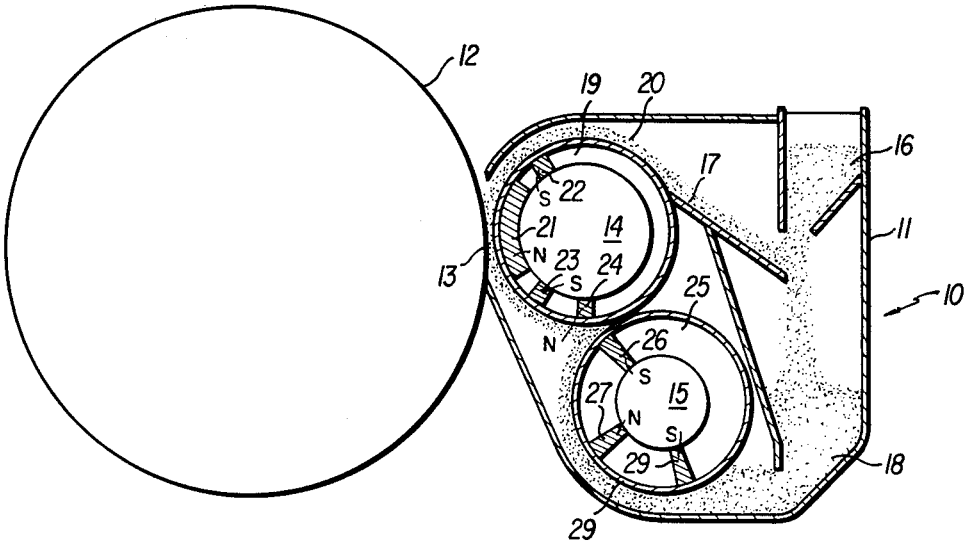
FIG. 2 diagrammatically illustrates a magnetic brush developing device according to a preferred embodiment of the present invention.

Referring to FIG. 2, there is diagrammatically illustrated at magnetic brush developing device 10 in accordance with the invention. A casing 11 has an open portion 13 facing a latent image bearing member 12, opening 13 covering the entire length in the axial direction of the latent image bearing member 12. Disposed in casing 11 are a developing roller 14 and a developer transporting roller 15 which are disposed in vertically contiguous relation with respect to each other; a toner feeding unit 16; a developer scraping baffle 17 facing developing roller 14; and a developer reservoir 18.

The developing roller 14 consists of a stationary cylindrical magnet 19 having plural magnetic poles, and a sleeve 20 rotatably mounted around the cylindrical magnet 19. The plurality of magnetic poles of cylindrical magnet 19 includes a developing magnetic pole 21 having a width large enough to effect development and upper and lower transporting magnetic poles 22 and 23 respectively disposed upwardly and downwardly of developing magnetic pole 21 in adjacent relation thereto. Upper and lower transporting magnetic poles 22 and 23 contribute to transportation of the developer. Respective transporting magnetic poles 22 and 23 are narrower in width than the developing magnetic pole 21. Disposed adjacent to transporting magnetic pole 23 and near to transporting roller 15 is an auxiliary magnetic pole 24, which smoothes the delivery of developer from transporting roller 15 to developing roller 14.

The magnetic poles of cylindrical magnet 19 are so arranged around the outer periphery of cylinder that their polarities may alternate with respect to each other. Thus, developing magnetic pole 21 may be a North pole while transporting magnetic poles 22 and 23 may be South poles while auxiliary transporting magnetic pole 24 would be a North pole.

The feeding of developer to developing roller 14 is effected by transporting roller 15, which also has a cylindrical magnet 25 as in developing roller 14. The cylindrical magnet 25 has a magnetic pole 26 disposed adjacent to and in facing relation to auxiliary transporting magnetic pole 24 of developing roller 14, the polarity of pole 26 being opposite to that of auxiliary magnetic pole 24. Magnetic poles 27 and 28 are disposed in facing relation to the developer transporting path and substantially apart from one another, the spacing between poles 26, 27 and 28 being preferably substantially equal with magnetic poles 27 and 28 being of opposite polarity with respect to each other. A cylindrical sleeve 29 is rotatably mounted around cylindrical magnet 25.

In operation of the magnetic brush developing device thus described, the developer from developer reservoir 18 is transported upwardly with the aid of cylindrical magnet 25 and cylindrical sleeve 29 of transporting roller 15 and then delivered to auxiliary transporting magnetic pole 24 of developing roller 14. The developer fed to developing roller 14 is transported to developing magnetic pole 21 by means of transporting magnetic pole 23 of cylindrical magnet 19 through rotation of sleeve 20. The developer is now formed into brush-like burs due to the magnetic field of developing magnetic pole 21, so that the burs of developer slidingly pass over the surface of the latent image bearing member 12 whereby development is achieved.

After completion of development, the developing agent, whose toner is reduced, is transported upwardly by means of transporting magnetic pole 22 towards developer scraping member 17 whereby the developer is scraped off of the surface of developing roller 14. The developer thus scraped off drops downwards joining with toner fed from the toner feeding unit 16 and is received by developing agent reservoir 18 to be uniformly mixed with the newly added toner.

Figure 1:
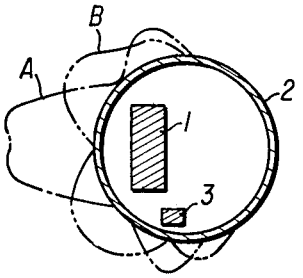
FIG. 1 (PRIOR ART)
FIG. 1 diagrammatically illustrates a developing roller used in a magnetic brush developing device of the prior art.
Figure 3:
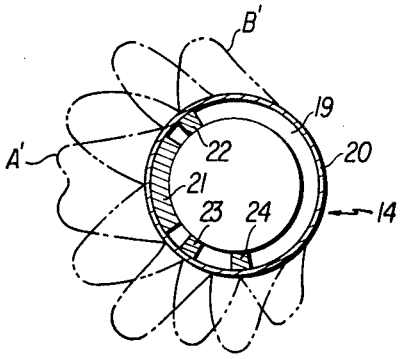
FIG. 3 is an explanatory view diagrammatically showing a developing roller using in the magnetic brush developing device of the present invention.

In the magnetic brush developing device according to the present invention, transporting magnetic poles 22 and 23 of cylindrical magnet 19 are disposed adjacent developing magnetic pole 21 so that flux density B′ in the direction tangential to developing magnetic pole 21 is large, as shown in FIG. 3, as compared to that of the rectangular magnet used in the prior art. This improves the transportability of developing magnetic pole 21 for the developer. Dotted line A′ in FIG. 3 represents a flux density in the direction perpendicular to the developing magnetic pole 21.

Because transportation of the developer is greatly improved, the permissible range of developer flow rate is increased. Increased developer flow rate permits increased developing speed without risk of leakage of the developer to the outside of the developing device.

Furthermore, even if a gap variation between latent image bearing member 12 and developing roller 14 arises, the stream of developer is maintained in a normal condition without the developer being leaked to the outside of the device, and thus an image of high quality will be reproduced.

What is claimed is:

1. A magnetic brush developing device comprising a developing roller including a cylindrical stationary magnet and a sleeve rotatably mounted around said magnet, said developing roller being disposed adjacent the surface of a latent image bearing member, said cylindrical magnet having a developing magnetic pole facing the surface of said latent image forming member and transporting magnetic poles respectively disposed above and below said developing magnetic pole in adjacent relation thereto, said transporting magnetic poles being narrower in width than and having an opposite polarity to said developing magnetic pole, said cylindrical magnet having an auxiliary magnetic pole disposed adjacent the transporting magnetic pole, the polarity of said auxiliary magnetic pole being the same as that of said developing magnetic pole, a developer reservoir and a transporting roller including a second cylindrical stationary magnet and a second sleeve rotatably mounted around said second magnet, said transporting roller being disposed below said developing roller and adjacent said developer reservoir, said second cylindrical magnet having a first magnetic pole being of opposite polarity to and disposed adjacent to and in facing relation to said auxiliary magnetic pole to smooth the delivery of the developer from said transporting roller to said developing roller, said second cylindrical magnet having further poles to effect the delivery of said developer from said reservoir to said first magnetic pole.

* * * * *